US007081809B1

(12) United States Patent
Mix et al.

(10) Patent No.: US 7,081,809 B1
(45) Date of Patent: Jul. 25, 2006

(54) ELECTRONIC PACE REGULATING, TIMING, AND COACHING DEVICE AND SYSTEM

(75) Inventors: John Mix, Byron, CA (US); Roar Viala, Oceanside, CA (US)

(73) Assignee: Finis INC, Byron, CA (US)

( * ) Notice: Subject to any disclaimer, the term of this patent is extended or adjusted under 35 U.S.C. 154(b) by 68 days.

(21) Appl. No.: 10/632,464

(22) Filed: Aug. 1, 2003

(51) Int. Cl.
*G08B 23/00* (2006.01)

(52) U.S. Cl. ..... 340/321; 340/323 R; 340/384.71; 340/396.1; 351/43; 351/158; 2/5; 2/426

(58) Field of Classification Search ..... 340/323 R, 340/326, 327, 328, 331, 815.69, 384.7, 384.71, 340/396.1, 309.16, 309.8, 309.9, 321; 482/3, 482/8; 235/105; 600/26, 27, 28; 377/24.2, 377/112; 2/5, 426; 351/41, 43, 158
See application file for complete search history.

(56) References Cited

U.S. PATENT DOCUMENTS 4,220,996 A * 9/1980 Searcy ..... 702/160
4,285,041 A * 8/1981 Smith ..... 482/3
4,337,529 A * 6/1982 Morokawa ..... 377/20
5,082,281 A * 1/1992 Berghofer ..... 473/207
5,125,010 A * 6/1992 Lee et al. ..... 377/24.2
5,599,274 A * 2/1997 Widjaja et al. ..... 600/27
5,921,890 A 7/1999 Miley ..... 482/3
5,956,630 A * 9/1999 Mackey ..... 455/344
6,301,367 B1 * 10/2001 Boyden et al. ..... 381/376
6,717,737 B1 * 4/2004 Haglund ..... 359/631
6,837,827 B1 * 1/2005 Lee et al. ..... 482/8

OTHER PUBLICATIONS

"The Aquapacer", Pacific Swim Coaches Clinic 2001, 6 pages.
"Aquapacer™", www.aquapacer.com, 1 page.
"Seagull Continues to Set the Pace", Seagull Inc., Published in Swimming world, Dec. 1977, 1 page.
"The New International Tempo Timer", Published in Swimming World, Jan. 1976, 1 page.
"Tempo Trainer- Your Personal Pace Coach", www.tempotrainer.com, Finish Inc., 2 pages.

* cited by examiner

*Primary Examiner*—Van T. Trieu
(74) *Attorney, Agent, or Firm*—Haverstock & Owens LLP

(57) ABSTRACT

This invention relates to systems to regulate pace. More particularly, this invention relates to providing a user with a regulated pace through the use of an electronic pace regulating, timing, and coaching device. In accordance with the instant invention, a portable programmable electronic device is configured to provide an audible signal at a repeated frequency that is selectable by the user. The pace timer and coaching device provides the user with a set audible cue at a set frequency to be followed during an exercise session. The audible cues provide a single regulated pace to be followed by the user while performing repetitive actions, motions, or strokes such that a desired training or racing pace is adhered to. The device is configured to detachably couple to swim goggles, to a user, to sunglasses, to an arm band, to exercise equipment, or to other articles of clothing utilized while exercising.

14 Claims, 3 Drawing Sheets

ELECTRONIC PACE REGULATING, TIMING, AND COACHING DEVICE AND SYSTEM

FIELD OF THE INVENTION

This invention relates to systems to regulate pace. More particularly, this invention relates to an electronic device which assists a user by regulating the pace of a repetitive activity.

BACKGROUND ON INVENTION

Exercise is generally used for relaxation/stress release, weight loss and muscle building, and as cardiovascular pulmonary conditioning. Cardiovascular pulmonary conditioning not only assists in relaxation/stress release, muscle building and body shaping, but also has the potential of prolonging life. For example, studies show that persons walking two miles in 30 minutes for three times per week, have a 58% percent reduction in deaths from heart attack or stroke.

According to fitness experts, to maximize the benefit of a cardiovascular workout, the heart rate should be raised to between 50 and 70 percent of its maximum. The maximum number of beats per minute is usually estimated to be 220 minus the person's age.

If a work-out falls far below that level, the heart is not obtaining the necessary challenge to get stronger. On the other extreme, if the heart is worked too hard, the body begins burning stored calories in a way that burns less fat and relies more on energy stored in muscle tissue. Thus, many people who exercise focus on their heart rates for optimal results. Heart rate training involves keeping track of the heart rate while exercising. Specifically, heart rate training can first be used to build a sound aerobic base with low intensity volume type work. Next, threshold heart rate training can be used as a means of improving central cardiovascular efficiency is used for optimal fitness results. Finally, lactate tolerance heart rate training can be used to prepare for the demands of competition.

Prior art device only serve to monitor the heart-rate of the user. The simplest models offer a continuous display of the number of beats per minute, while other models calculate the time spent in the target heart rate zone, double as a stopwatch, calculate maximum heart rate, and display the average heart rate for each lap. For example, current models include a strap worn around the rib cage while exercising. The strap transmits a radio signal to a wristwatch-like device that displays the user's heart rate. The user is then required to estimate a tempo or pace to follow to maintain a desired heart rate. Further, since the majority of exercise entails, to a certain degree, a repetitive action, there is a need for users to regulate the pace of their repetitive activity.

By trial and error, experienced athletes, are able to analyze, with varying degrees of accuracy, whether or not a particular training session on a certain day is achieving heart rate training goals. However, there are so many factors that can effect such trial and error analysis from one session to the next that this form of analysis is generally unpredictable to attain optimal fitness results and ascertain whether training goals and objectives are being met.

SUMMARY OF THE INVENTION

The current invention provides a very simple, effective, and efficient manner to develop a consistent rate at an optimal training or race pace. Specifically, the current invention is a simplified portable electronic device that transmits an audible cue, preferably a beep, to help develop consistency of a repetitive action or activity, such as a stroke, peddle, or leg rate, and assist in reaching optimal training and race paces. The current invention assists users to regulate the pace of their repetitive activity. This device acts as a personal pace coach that elevates training and maximizes performance. Further, the current invention provides the user with a tool to adapt and vary training session objectives including, but not limited to, repetitive action pacing, increased quality training sessions, and regulation of pace for recovery training sessions.

Simply by pressing buttons, the electronic pace coaching device also provides the user with a recurring audible cue that can be set by the user to correspond to a single pre-set frequency ranging from tenths of a second to minutes. These frequencies (and associated audible cues), can be set to correspond to a desired training pace, speed or goal, such as the users anaerobic threshold, for example.

Specifically, embodiments of the current invention disclose a portable electronic device configured for providing an audible signal at a repeated frequency selectable by a user. The preferred embodiment is a portable electronic device configured to provide an audible signal at a repeated frequency selectable by a user. The electronic device comprises a timing unit contained within a waterproof housing. The preferred timing unit comprises a plurality of buttons configured to allow the user to select a single frequency as the repeated frequency. Further, the timing unit comprises a display configured to display a numerical representation of the repeated frequency selected by the user and a power source. The preferred electronic device also comprises a detachable clip member configured to detachably couple to the timing unit. The repeated frequency preferably corresponds to an interval between two tenths of a second to ten minutes.

In addition, the current invention may be configured to have a clock. The clock not only informs the user of the time, but may also be programmed with a duration setting which would provide the user with an audible signal at a repeated signal for a specific duration. The preferred portable electronic device further comprises a clip member and the clip member is configured to detachably couple. An embodiment of the clip member is configured to detachably couple to swim goggles. In addition, the embodiments of the current invention further comprise a display configured to display a numerical representation of the repeated frequency selected by the user and a power source configured to provide power to the electronic components of the current invention.

In alternate embodiments of the current invention, a electronic pacing device is disclosed comprising a programmable timing circuit configured to allow a user to select a pacing frequency and a means for providing an audible signal corresponding the pacing frequency. The preferred electronic pacing device further comprises a clip member and a housing and the housing is waterproof and is formed from a high impact plastic. The preferred clip member is configured to detachably couple to housing and to an article of clothing. An embodiment of the clip member is configured to detachably couple to swim goggles. In yet other embodiments, the clip member is configured to detachably couple to a user, to sunglasses, to an arm band, to exercise equipment, or to other articles of clothing utilized while exercising. Further, the preferred embodiment has a display that is configured to display a numerical representation of the set frequency interval set by the user.

Further alternate embodiments of the electronic pacing device are configured such that the programmable timing circuit permits the user to select a duration of time for which the audible signal is to be provided and is further configured to store preferred settings inputted by the user. The preferred pacing frequency is an interval between two tenths of a second and ten minutes.

In other embodiments, the current device further comprises a programmable timer configured to be programmed with a set frequency interval, a timer, and a means for inputting controls to the device. The means for inputting controls to the device is configured to turn the device on and off and program the set frequency interval. The timer could further comprises a storage means configured to record, receive, and store use data and output a user outcome. In yet other embodiments, the device could further comprise a processor chip with firmware configured, for example, to convert cycle rates to cycles per a unit time.

DETAILED DESCRIPTION OF THE PREFERRED EMBODIMENTS

The device, system and method utilize an electronic device to provide a user with a regulated pace. In accordance with the instant invention, the programmable electronic pace timer and coaching device provides the user with a set audible cue at a set frequency to be followed during an exercise session. The audible cue provides an regulated pace to be followed by the user such that an optimal training or racing pace is adhered to. In an embodiment of the instant invention, the device is utilized by swimmers and is detachably coupled to swim goggles. The device can be programmed to suit the pace goals of an individual and can be used to further assist the user to optimizing training and/or racing paces to achieve these user goals.

The chart below details the preferred stroke rate, seconds per cycle, and seconds per stroke that the set audible cue at a set frequency correspond to and are provided to the user by the programmable electronic pace timer and coaching device.

| Stroke Rate (Cycles per Minute) | Seconds per Cycle | Seconds per Stroke |
|---|---|---|
| 20 | 3.00 | 1.50 |
| 21 | 2.86 | 1.43 |
| 22 | 2.73 | 1.36 |
| 23 | 2.61 | 1.30 |

-continued

| Stroke Rate (Cycles per Minute) | Seconds per Cycle | Seconds per Stroke |
|---|---|---|
| 24 | 2.50 | 1.25 |
| 25 | 2.40 | 1.20 |
| 26 | 2.31 | 1.15 |
| 27 | 2.22 | 1.11 |
| 28 | 2.14 | 1.07 |
| 29 | 2.07 | 1.03 |
| 30 | 2.00 | 1.00 |
| 31 | 1.94 | 0.97 |
| 32 | 1.88 | 0.94 |
| 33 | 1.82 | 0.91 |
| 34 | 1.76 | 0.88 |
| 35 | 1.71 | 0.86 |
| 36 | 1.67 | 0.83 |
| 37 | 1.62 | 0.81 |
| 38 | 1.58 | 0.79 |
| 39 | 1.54 | 0.77 |
| 40 | 1.50 | 0.75 |
| 41 | 1.46 | 0.73 |
| 42 | 1.43 | 0.71 |
| 43 | 1.40 | 0.70 |
| 44 | 1.36 | 0.68 |
| 45 | 1.33 | 0.67 |
| 46 | 1.30 | 0.65 |
| 47 | 1.28 | 0.64 |
| 48 | 1.25 | 0.63 |
| 49 | 1.22 | 0.61 |
| 50 | 1.20 | 0.60 |
| 51 | 1.18 | 0.59 |
| 52 | 1.15 | 0.58 |
| 53 | 1.13 | 0.57 |
| 54 | 1.11 | 0.56 |
| 55 | 1.09 | 0.55 |
| 56 | 1.07 | 0.54 |
| 57 | 1.05 | 0.53 |
| 58 | 1.03 | 0.52 |
| 59 | 1.02 | 0.51 |
| 60 | 1.00 | 0.50 |
| 61 | 0.98 | 0.49 |
| 62 | 0.97 | 0.48 |
| 63 | 0.95 | 0.48 |
| 64 | 0.94 | 0.47 |
| 65 | 0.92 | 0.46 |
| 66 | 0.91 | 0.45 |
| 67 | 0.90 | 0.45 |
| 68 | 0.88 | 0.44 |
| 69 | 0.87 | 0.43 |
| 70 | 0.86 | 0.43 |
| 71 | 0.85 | 0.42 |
| 72 | 0.83 | 0.42 |
| 73 | 0.82 | 0.41 |
| 74 | 0.81 | 0.41 |
| 75 | 0.80 | 0.40 |
| 76 | 0.79 | 0.39 |
| 77 | 0.78 | 0.39 |
| 78 | 0.77 | 0.38 |
| 79 | 0.76 | 0.38 |
| 80 | 0.75 | 0.38 |
| 81 | 0.74 | 0.37 |

Figure 1A:
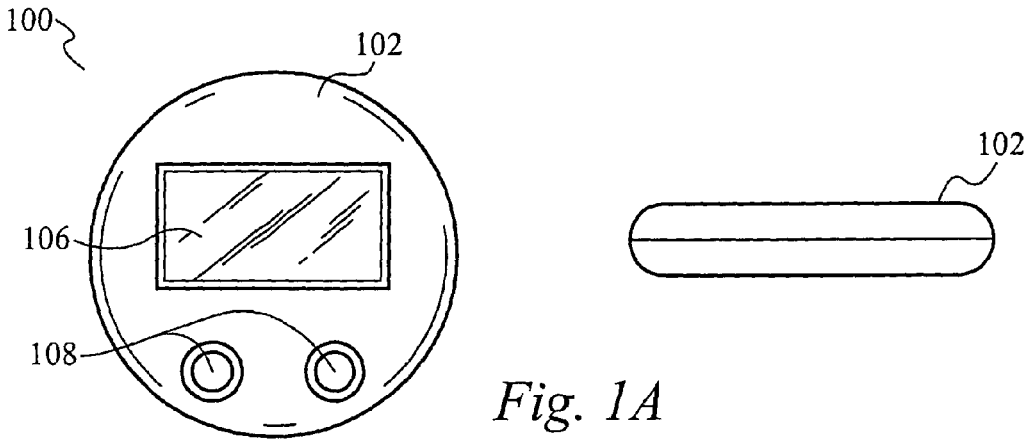
FIG. 1A shows a front and side view of a portable programmable electronic device, in accordance with the current invention.
Figure 1B:
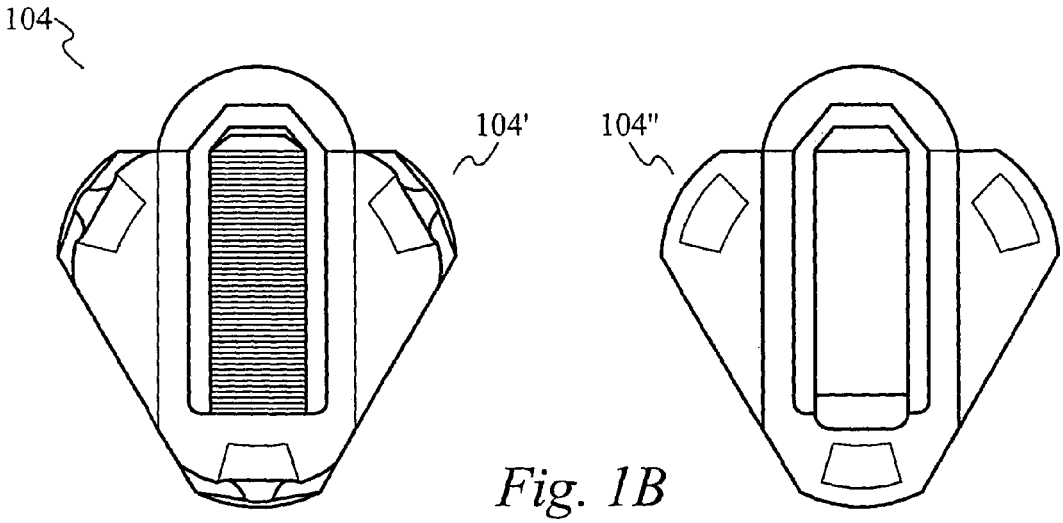
FIG. 1B shows a front and back view of a clip member for the portable programmable electronic device shown in FIG. 1A, in accordance with the current invention.
Figure 1C:
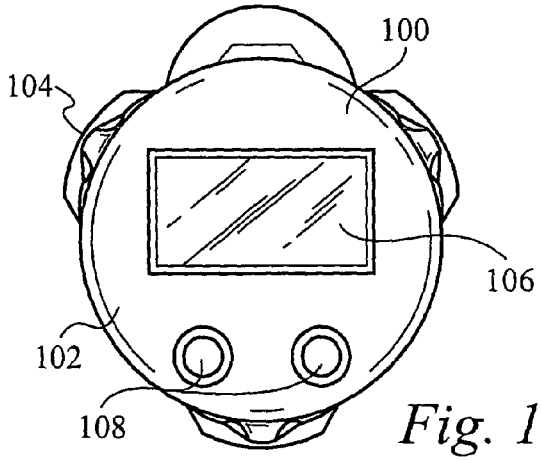
FIG. 1C shows a front view of the portable programmable electronic device with the clip member detachably coupled, in accordance with the current invention.

FIG. 1A shows a front and side views of a portable electronic device 100 configured for providing an audible signal at a repeated frequency, wherein the frequency is selectable by the user. Preferably, the repeated frequency is an interval between two tenths of a second to ten minutes. In the preferred embodiment of the current invention, the device 100 comprises a timing unit (not shown) contained within a waterproof housing 102 and a detachable clip member 104 configured to detachably couple to the housing 102. The front view 104' and the back view 104" of the clip member 104 is shown in greater detail in FIG. 1B. The clip member 104 is preferably configured to detachably couple to the device 100 as shown in FIG. 1C. The clip member 104 is further configured to detachably couple to an article of clothing or exercise equipment. For example, in one embodiment, the clip member 104 is configured to detachably couple to swim goggles (not shown). In alternate embodiments of the current invention, the clip member 104 is configured to couple to a user (not shown), to sunglasses (not shown), to an arm band (not shown), to exercise equipment (not shown), or to other articles of clothing utilized while exercising.

Figure 1D:
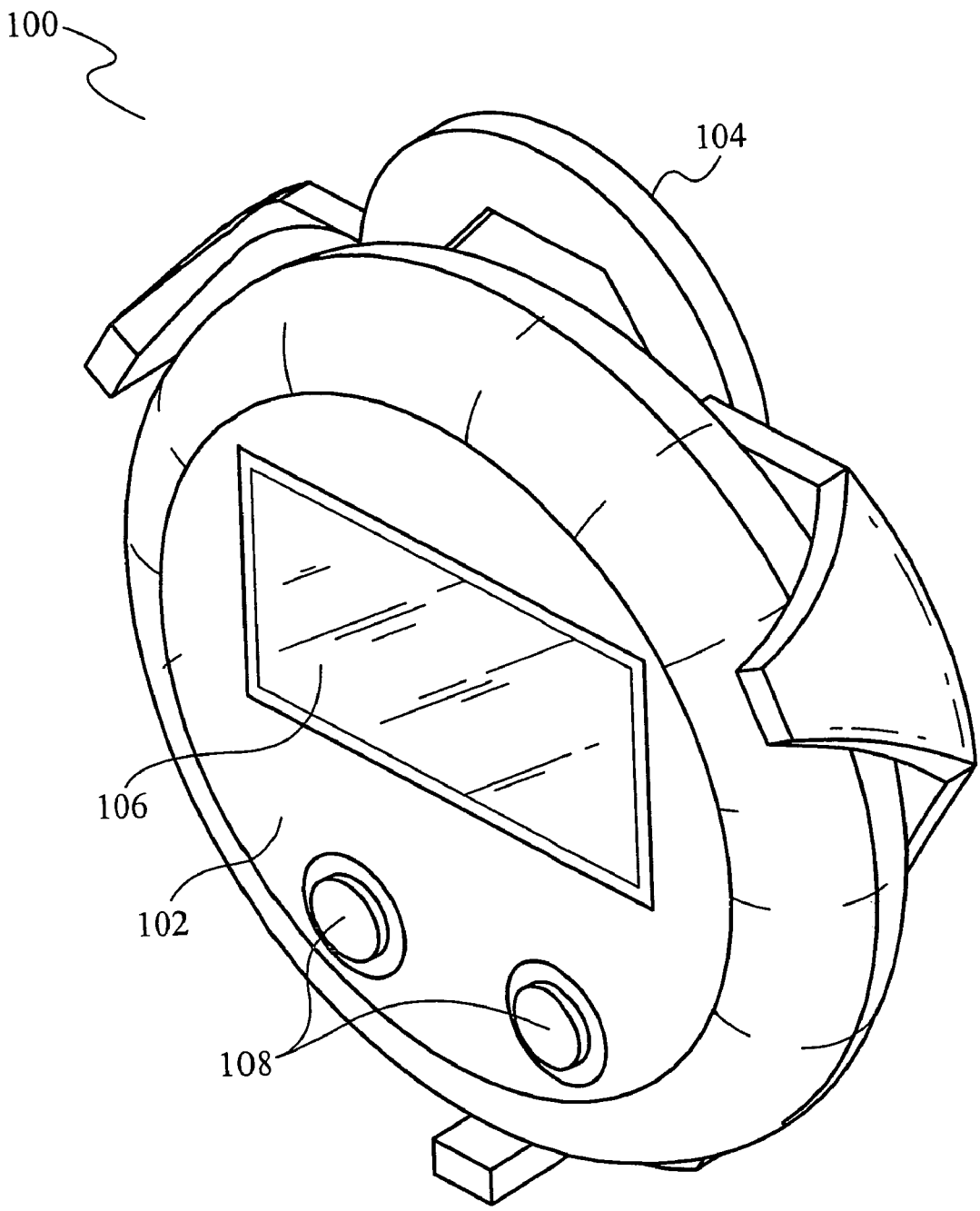
FIG. 1D shows a perspective view of the portable programmable electronic device with the clip member detachably coupled, in accordance with the current invention.

Further, in the preferred embodiment of the current invention, the timing unit of the device 100 comprises a display 106 configured to display a numerical representation of the repeated frequency selected by the user. The display 106 is preferably LCD. The timing unit of the preferred device 100 further comprises a power source (not shown). The power source preferably comprises a battery. But, the power source may comprise a solar powered cell, motion power, or other means. In addition, the timing unit of the preferred device 100 further comprises a means for inputting controls 108. The means for inputting controls 108 preferably is a plurality of buttons configured to allow the user to select a single frequency as the repeated frequency and to allow a user to turn the device 100 on and off. FIG. 1D shows a perspective view of the preferred embodiment of the device 100.

Figure 2:
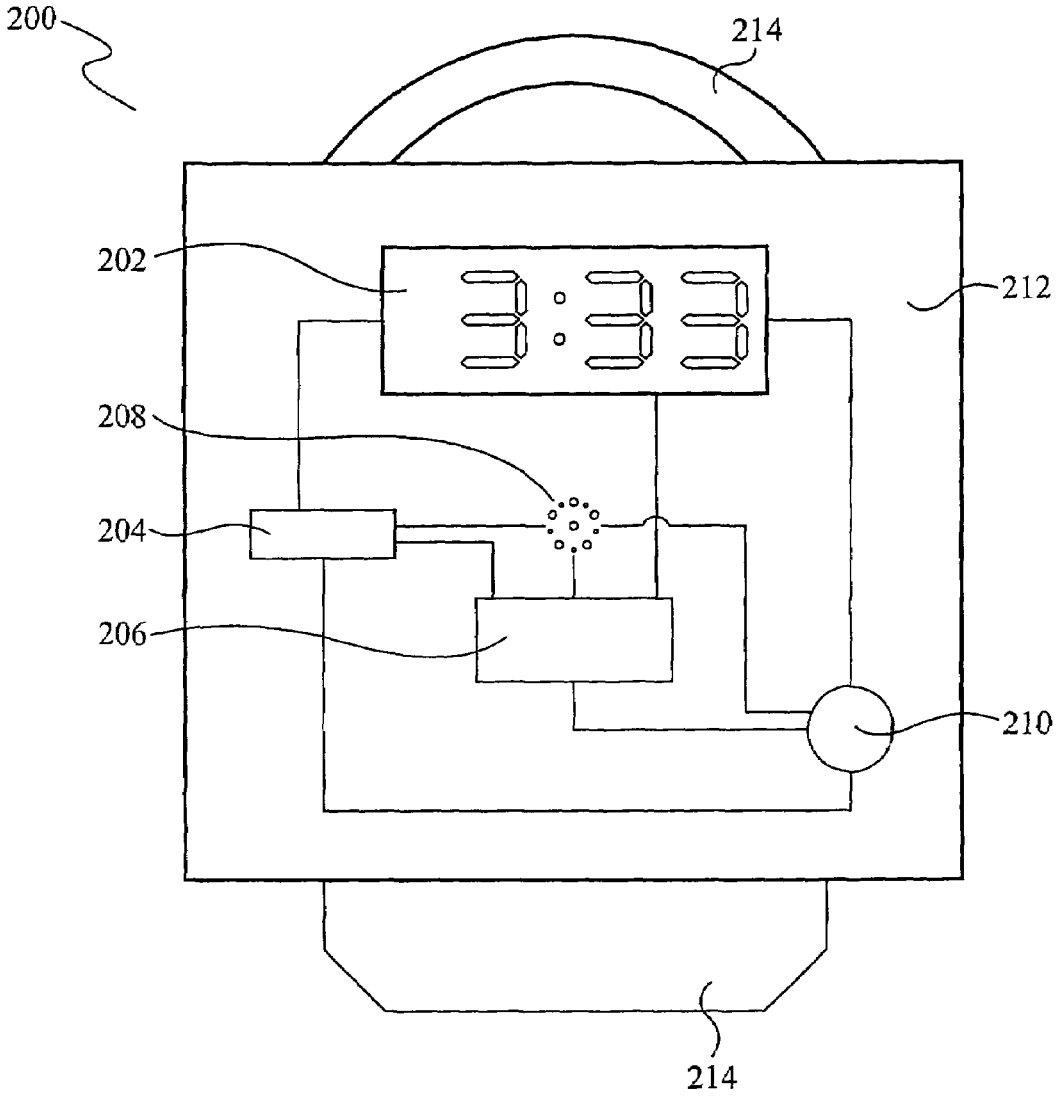
FIG. 2 shows a front view of a electronic pacing device, in accordance with the current invention.

FIG. 2 shows a electronic pacing device 200. Specifically, the device 200 comprises a display 202 configured to display a numerical representation of the set frequency interval, a programmable timing circuit 204 configured to allow a user to select a pacing frequency, a means for programming (or alternatively a means for inputting controls) 206 configured to turn the device 200 on and off and to program the set frequency interval, a means for providing an audible signal 208 at a repeated frequency, a power source 210 configured to provide power to the device 200, and a housing 212 for holding the display 202, the programmable timing circuit 204, the means for programming 206, the means for providing an audible signal 208, and the power source 210. The housing 212 is preferably waterproof and is formed from a high impact plastic.

The device 200, further comprises a detachable clip member 214. The detachable clip member 214 is configured to detachably couple to an article of clothing and detachably coupled to the housing 212. In alternate embodiments, the clip member 214 is configured to detachably couple to a user, to exercise equipment, or to swim goggles and detachably coupled to the housing 212.

The programmable timing circuit 204 is preferably configured to allow the user to select a duration of time for which the audible signal is to be provided. The programmable timing circuit 204 in the preferred embodiment of the current invention is further configured to store preferred settings inputted by the user. In alternate embodiments of the current invention, the programmable timing circuit 204 is further configured to calculate a rate based on the user's speed and tempo. In addition, the programmable timing circuit 204 may alternately be configured to calculate optimal training or race paces based on data inputted by a user. In alternate embodiments of the current invention, the device 200 may further comprise a electronic clock (not shown) configured not only to tell time, but also to be programmed with a duration setting which would provide the user with an audible signal at a repeated signal for a specific duration.

The audible signal provided by the means for providing the audible signal 208 corresponds to the pacing frequency programmed into the timing circuit 204. In the preferred embodiment of the current invention, the pacing frequency is an interval between two tenths of a second and ten minutes and the means for providing an audible signal at a repeated frequency is configured to provide an audible signal at the pacing frequency interval. In embodiments of the current invention, the audible signal or cue provided is repeated at the set frequency interval corresponding to a distance per cycle programmed into the programmable timing circuit 204. In embodiments of the current invention, the distance per cycle is for a stroke, for a stride, for a step, or for a bicycle peddle. In yet another embodiment, the device 200 may comprise a programmable timer (not show) configured to be programmed with a set frequency interval instead of the programmable timing circuit 204.

In alternate embodiments of the current invention, the device 200 further comprises an converter circuit (not shown). The converter circuit can be configured to convert cycle rates to cycles per minute or cycles per a unit time. Further, in alternate embodiments of the current invention the device 200 further comprise a storage means (not shown) configured to record, receive, and store use data and output a user outcome.

In yet further alternate embodiments of the current invention, the device 200 further comprises a means for linking (not shown). The means for linking is configured to send and receive cycle and tempo data to and from an external device (not shown). The external device may be a computer, a heart monitor, or other electronic device. In yet another alternate embodiment, the device 200 further comprises a session data recorder (not shown). The session data recorder comprises a electronic log or workbook.

The current waterproof invention provides a very easy to use and effective way device for finding efficient tempos and paces. The detachable clip member allows the user to easily remove or attach the device to swim goggles, for example, while the buttons allow a user to easily input, select, and adjust a audible cue corresponding to a single desired training pace. Although pulse-readings may be taken by cardio-monitors, this invention differs in that it provides an repeated audible cue set by the user to correspond to a pace or a tempo, regardless of the user's pulse. Further, the current device can be used to provide the user the distance per cycle. Once the distance per cycle is established, the current invention can provide the user with a cycle rate to increase or decrease the pace to determine the user's ideal training and racing tempo and pace. In addition, the current invention provides the user with a means to maintain consistent intervals, during circuit training, for example.

The present invention has been described in terms of specific embodiments incorporating details to facilitate the understanding of the principles of construction and operation of the invention. Such reference herein to specific embodiments and details thereof is not intended to limit the scope of the claims appended hereto. It will be apparent to those skilled in the art that modifications may be made in the embodiments chosen for illustration without departing from the spirit and scope of the invention.

What is claimed is:

1. A portable electronic device wherein the portable electronic device is configured to provide an audible signal at a repeated frequency selectable by a user wherein the repeated frequency corresponds to an interval between two tenths of a second and ten minutes and wherein the electronic device comprises:

a. a timing unit contained within a waterproof housing, wherein the timing unit comprises:

i. a plurality of buttons configured to allow the user to select a single frequency as the repeated frequency;

ii. a display configured to display a numerical representation of the repeated frequency selected by the user; and iii. a power source; and b. a detachable clip member configured to detachably couple to the timing unit and to a pair goggles.

2. The portable electronic device of claim 1, wherein the plurality of buttons are further configured to turn the portable electronic device on and off and to increase or decrease the single frequency selected by the user.

3. The portable electronic device of claim 1, wherein the timing unit is waterproof and is formed from a high impact plastic.

4. A electronic pacing device comprising:

a. a housing, comprising:

i. a programmable timing circuit configured to allow a user to select a single pacing frequency through a plurality of buttons;

ii. means for providing an audible signal corresponding to the pacing frequency; and b. a clip member configured to detachably couple the housing and to eye wear.

5. The electronic pacing device of claim 4, wherein the housing is waterproof and is formed from a high impact plastic.

6. The electronic pacing device of claim 4, wherein the programmable timing circuit is further configured to allow the user to select a duration of time for which the audible signal is to be provided.

7. The electronic pacing device of claim 4, wherein the pacing frequency is an interval between two tenths of a second and ten minutes.

8. The electronic pacing device of claim 4, wherein the programmable timing circuit is further configured to store preferred settings inputted by the user.

9. An electronic tempo device comprising a detachable clip member for detachably coupling to goggles and detachably coupling to a housing and wherein the housing comprises:

a. a programmable timer configured to be programmed with a single set frequency interval;

b. means for providing a repeated audible cue at the set frequency interval;

c. a display configured to display a numerical representation of the set frequency interval;

d. a power source configured to provide power to the means for providing a repeated audible cue and the programmable timer; and e. means for inputting controls to the device, wherein the means for inputting controls to the device is configured to turn the device on and off and program the set frequency interval.

10. The electronic tempo device of claim 9, wherein the timer further comprises a storage means configured to record, receive, and store use data and output a user outcome.

11. The electronic tempo device of claim 9, further comprising a processor chip with firmware.

12. The electronic tempo device of claim 11, wherein the processor chip with firmware is configured to convert cycle rates to cycles per a unit time.

13. The electronic tempo device of claim 9, wherein the housing is waterproof and is formed from a high impact plastic.

14. A timing device comprising a clip member for detachably clipping to a goggle strap and detachably coupling to a waterproof housing unit for housing:

a. a timing unit contained within the waterproof housing, wherein the timing unit comprises and input means to select an input a frequency corresponding to an interval between two tenths of a second and ten minutes;

b. an audio means to produce a sound corresponding to the frequency; and c. a power source.

* * * * *